US005848484A

United States Patent [19]

Dupree et al.

[11] Patent Number: 5,848,484

[45] Date of Patent: Dec. 15, 1998

[54] CONVERTIBLE ATHLETIC SHOE

[76] Inventors: Tony L. Dupree, 55 Garner Rd., Selma, N.C. 27576; Hal G. Abbott, 1211 Perdido Ct., Garner, N.C. 27529; Linwood J. Jones, 449 Grill Rd., Clayton, N.C. 27520

[21] Appl. No.: 792,975

[22] Filed: Feb. 3, 1997

[51] Int. Cl.[6] ..... A43B 3/24; A43B 5/00; A43B 23/02

[52] U.S. Cl. ..... 36/101; 36/100; 36/114; 36/136

[58] Field of Search ..... 36/54, 89, 100, 36/101, 109, 114, 132, 136

[56] References Cited

U.S. PATENT DOCUMENTS

| | | | |
|---|---|---|---|
| D. 280,567 | 9/1985 | Ji | 36/101 |
| 2,022,554 | 11/1935 | Williams | 36/54 |
| 4,958,447 | 9/1990 | DuPree | 36/114 |
| 5,065,531 | 11/1991 | Prestridge | 36/101 |
| 5,109,614 | 5/1992 | Curry | 36/136 |

FOREIGN PATENT DOCUMENTS

| | | | |
|---|---|---|---|
| 4403044 | 8/1994 | Germany | 36/136 |

*Primary Examiner*—Paul T. Sewell
*Assistant Examiner*—Anthony Stashick
*Attorney, Agent, or Firm*—Rhodes, Coats & Bennett, L.L.P.

[57] ABSTRACT

An athletic shoe is convertible from a low-top shoe to a high-top shoe. The convertible shoe includes a sole portion, an upper attached to the sole portion, and a detachable high-top. A securing strap secures the high-top to the upper. Both the upper and the detachable high-top include a series of slots through which the securing strap extends. To secure the high-top to the shoe, the securing strap is fed through each of the slots in the high-top and the upper respectively.

17 Claims, 10 Drawing Sheets

CONVERTIBLE ATHLETIC SHOE

FIELD OF THE INVENTION

The present invention relates generally to the field of athletic shoes and more particularly, to athletic shoes having a detachable high-top for converting a low-top athletic shoe to a high-top athletic shoe.

BACKGROUND OF THE INVENTION

Athletic shoes for use in various athletic activities, such as running, basketball, soccer, and football, have been constructed in basically two styles—low-top shoes and high-top shoes. Low-top shoes are generally preferred for activities such as running, tennis, or soccer because they do not impinge on the movement of the ankle. High-top shoes, on the other hand, are generally preferred for activities which involve jumping, such as basketball or other activities where increased ankle support is necessary. Presently, persons engaged in a variety of activities will purchase both low-top and high-top shoes to use. However, many people cannot afford to purchase two sets of shoes and must make do with only a single pair of shoes even though it may not be suited for all the activities in which the purchaser is engaged.

Therefore, there is a need for an athletic shoe which is convertible between a low-top shoe and a high-top shoe.

DESCRIPTION OF PRIOR ART

Convertible shoes are not entirely unknown. For example, the patent to Dupree, U.S. Pat. No. 4,958,447 discloses an athletic shoe with a detachable high-top. The high-top wraps around the wearer's ankle and overlaps with the shoe upper. Velcro® type fasteners are used to secure the high-top to the upper. Attaching the high-top to the upper converts the shoe from a low-top athletic shoe to a high-top athletic shoe.

SUMMARY OF THE INVENTION

The present invention provides an athletic shoe which is convertible from a low-top shoe to a high-top shoe. The shoe of the present invention includes a sole portion, an upper attached to the sole portion, and a detachable high-top. A securing strap secures the high-top to the upper. Both the upper and the detachable high-top include a series of slots through which the securing strap extends. Once the securing strap is fed through each of the slots, the high-top is securely fastened to the shoe upper.

In a preferred embodiment of the invention, the securing strap involves two free ends with lace holes that align with corresponding lace holes in the shoe upper. The shoe lace threads through the lace holes in the securing strap so that when the shoe lace is tied, the securing strap is placed in tension, thereby providing increased support for the heel.

Also, in a preferred embodiment of the invention, the shoe upper includes one or more pockets in which the lower edge of the detachable high-top is received. The outer flap of the pocket conceals the lower edge of the high-top.

In another aspect of the present invention, the shoe includes a single tongue which is long enough to extend to the top of the high-top when the high-top is attached to the upper. When the high-top is removed, the tongue folds back on itself and tucks underneath the shoelaces.

DETAILED DESCRIPTION OF THE INVENTION

Figure 1:
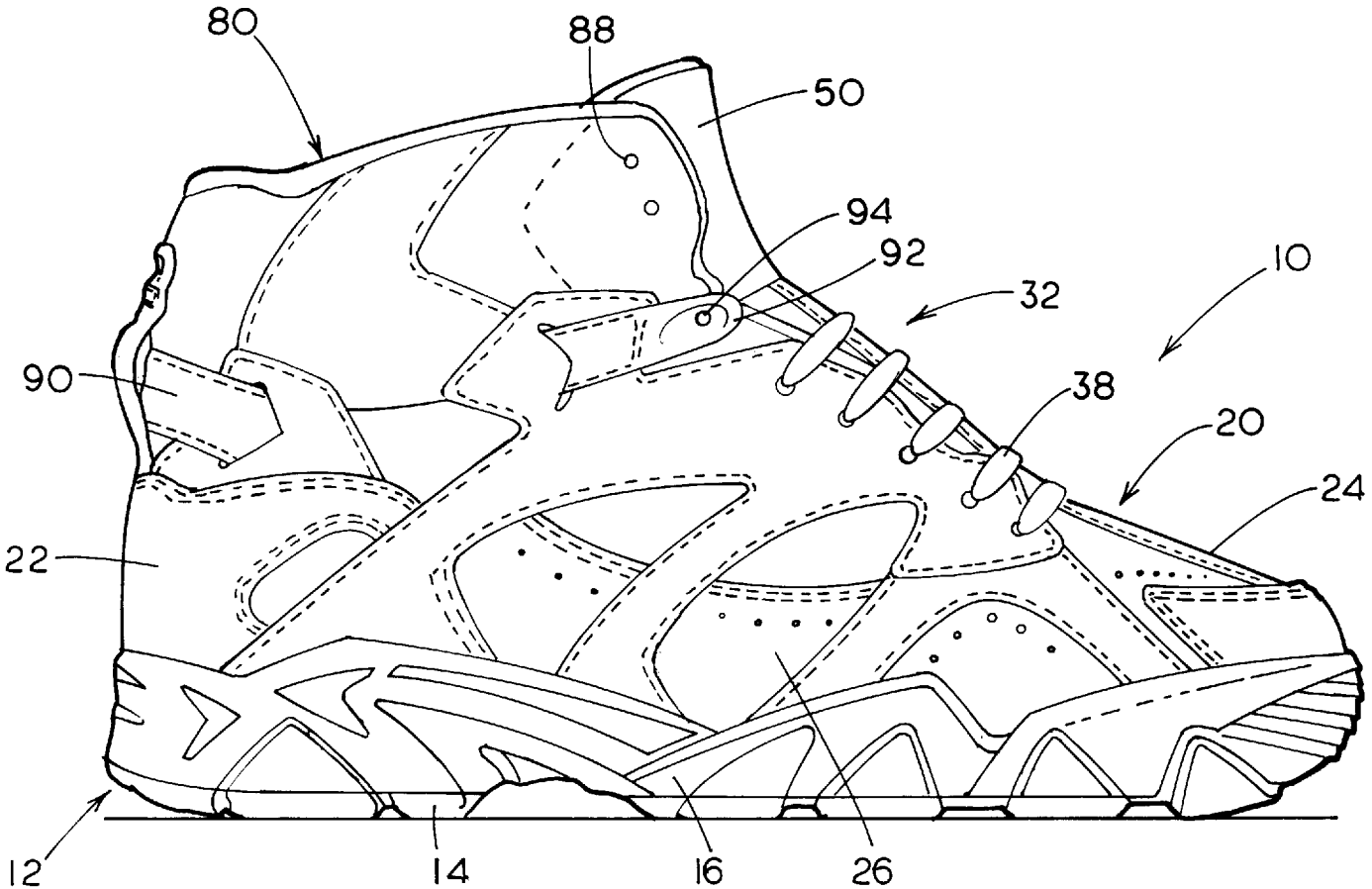
FIG. 1 an elevation view of the convertible athletic shoe of the present invention showing the high-top attached to the upper.

The present invention is described more fully hereinafter by referring to the drawings in which preferred embodiments are depicted. However, the present invention may take on many different embodiments and is not intended to be limited to the embodiments described herein.

Figure 2:
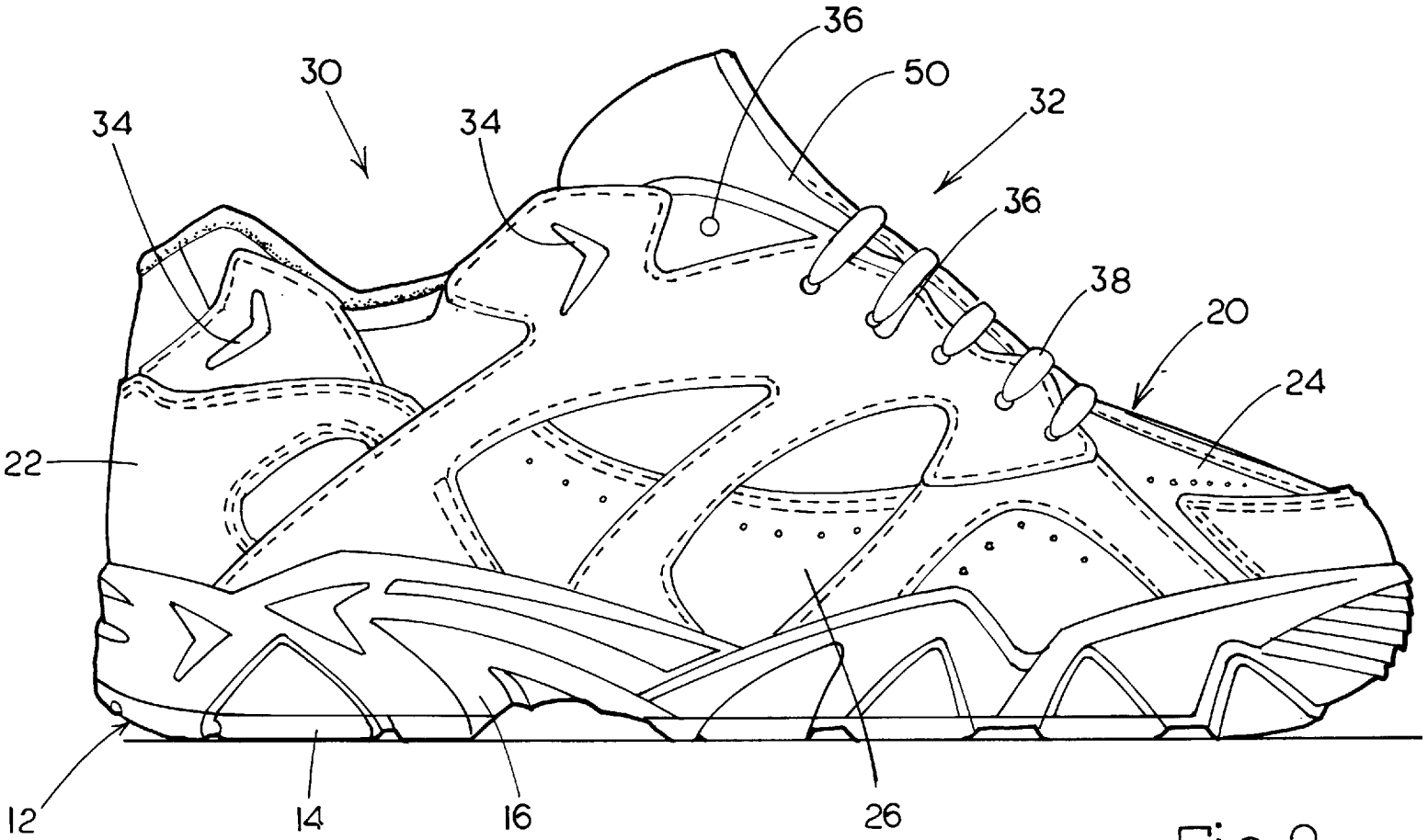
FIG. 2 is an elevation view of the convertible athletic shoe with the high-top removed.
Figure 3:
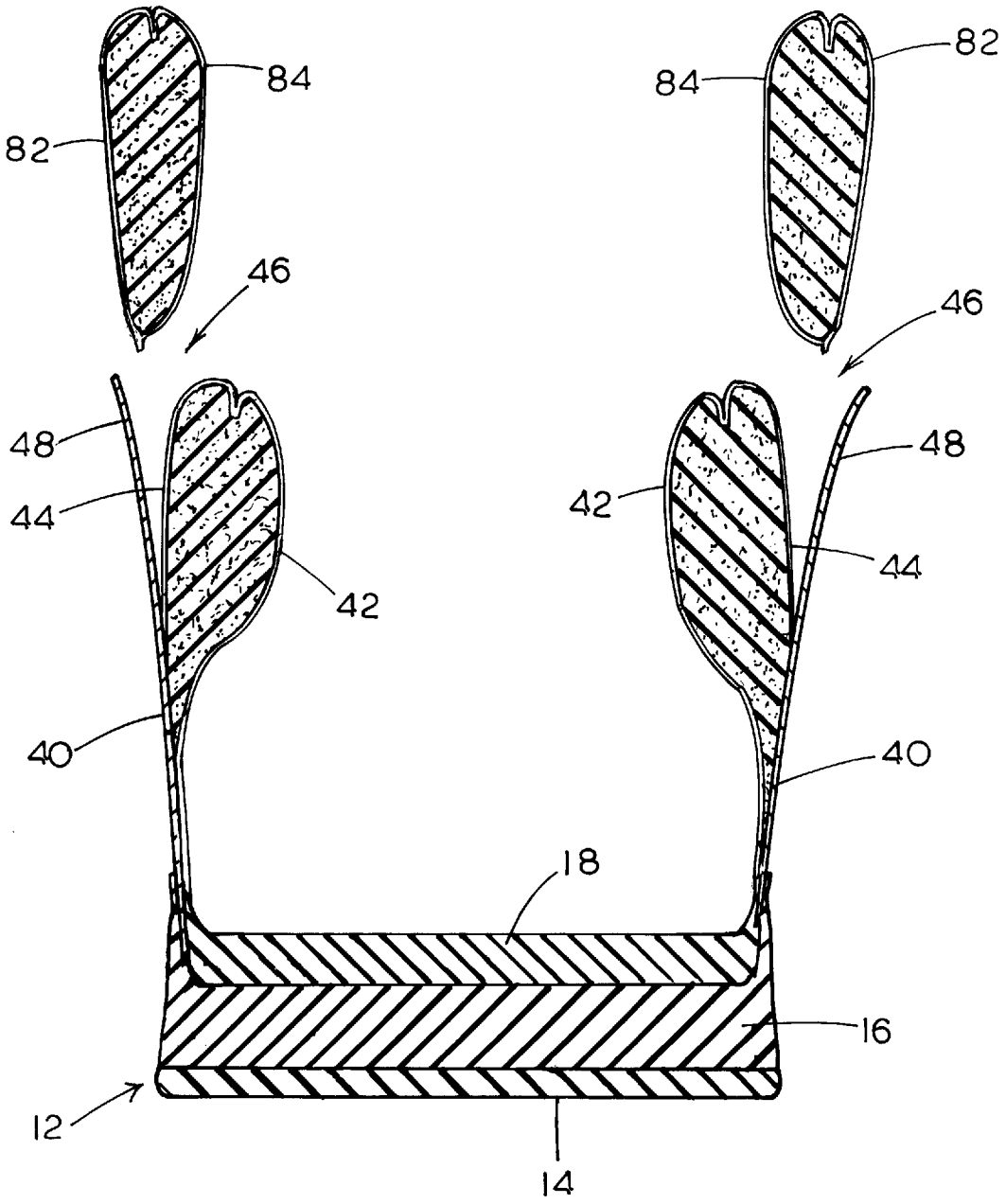
FIG. 3 is a cross-section of the shoe showing the sole assembly and the upper.

Referring now to FIGS. 1–3, the athletic shoe 10 of the present invention is shown. The athletic shoe 10 includes a sole assembly 12, an upper 20 which is attached to the sole assembly 12 and a detachable high-top 80 which can be releasably secured to the upper 20.

The sole assembly 12 is constructed in a conventional manner. The sole assembly 12 includes an outsole portion 14 made of rubber, a midsole portion 16, and an insole 18. The bottom of the outsole portion 14 may include treads, cleats, or lugs depending upon the intended use of the shoe. The midsole 16, which may be a single layer or multiple layers, is preferably made of a resilient cushioning material such as an EVA sponge. Since the construction of the sole assembly 12 is already well known to those skilled in the art, further discussion of the same will be omitted.

The upper 20 is joined along its lower edge to the sole assembly 12. The upper 20 is preferably made of a strong, wear resistant material such as leather or vinyl. Other materials, such as canvas or nylon mesh, can also be used.

The upper 20 includes a heel portion 22, a toe portion 24, and a midsection 26. The heel portion 22 is the portion which extends around the back of the wearer's heel. The toe portion 24 is the portion of the upper 20 which covers the front end of the wearer's foot including the wearer's toes. The midsection 26 is the portion of the upper 20 which extends between the heel portion 22 and the toe portion 24.

The upper 20 defines an ankle opening 30 through which the foot is inserted into the shoe. A tongue opening 32 extends from the ankle opening 30 forward to the toe portion 24 of the upper 20. The tongue opening 32 divides the midsection of the upper 20 into two halves. A tongue 50 is attached to the toe portion 24 and extends rearwardly along the tongue opening 32 to the ankle opening 30. A series of lace holes 36 extend along the midsections 26 of the upper 20 on both sides of the tongue opening 34. A shoe lace 38 is threaded through the lace holes 36 in a conventional manner and serves to secure the shoe to the foot of the wearer. It is appreciated, however, that other fastening means may be utilized in connection with the present invention, such as Velcro® fasteners, buckles, and straps.

Figure 4:
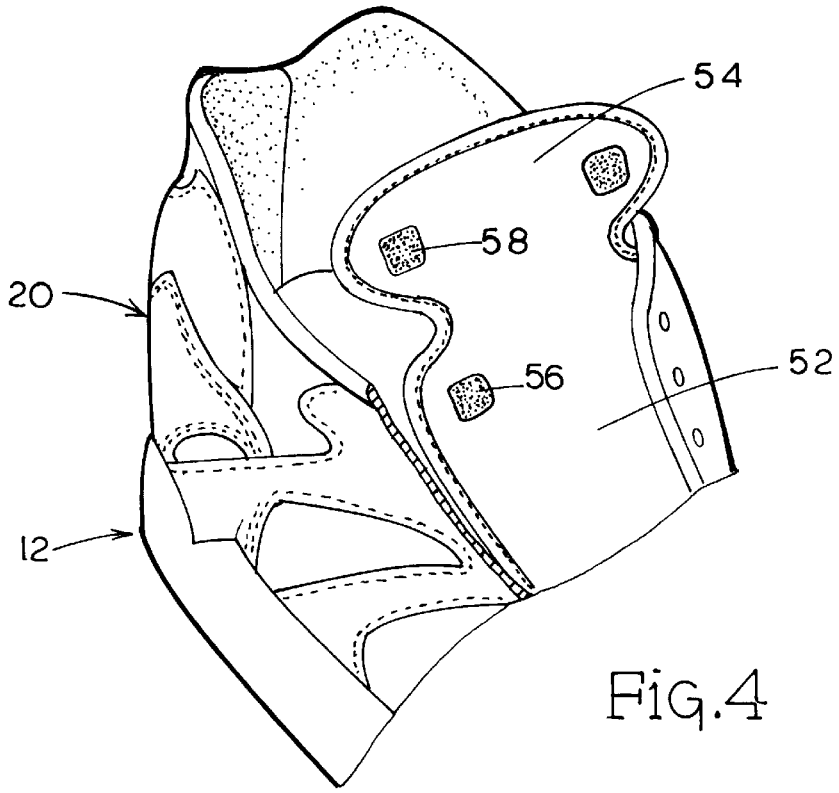
FIG. 4 is partial perspective view showing the tongue in an unfolded condition.
Figure 5:
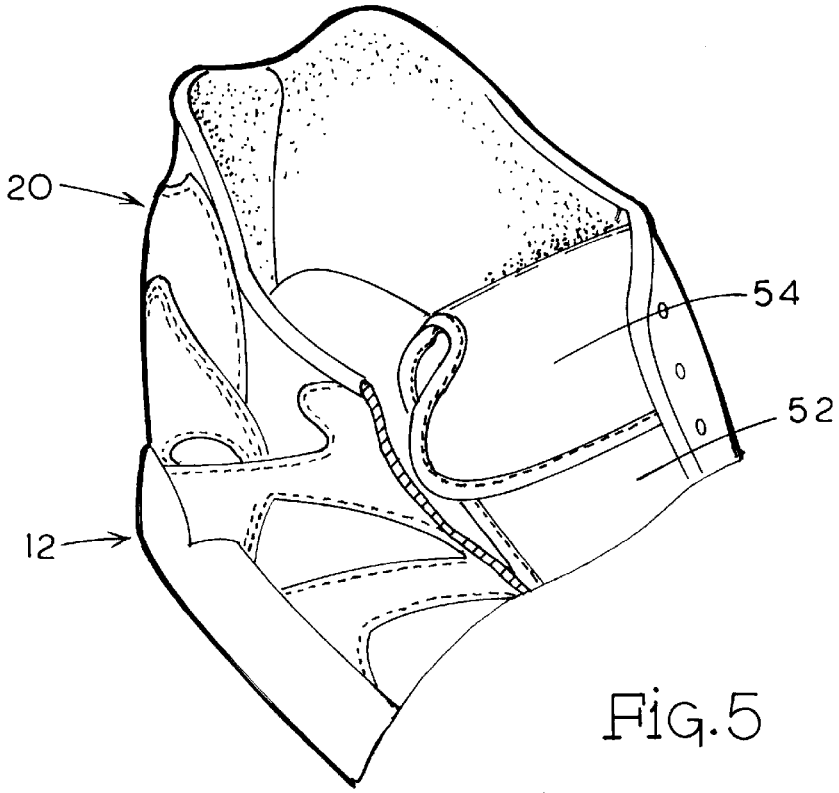
FIG. 5 is a partial perspective view showing the tongue in a folded condition.

A tongue 50, as previously mentioned, is attached to the toe portion 24 of the upper 20 and extends along the tongue opening 32. The tongue 50 is shown more clearly in FIGS. 4 and 5. The tongue 50 includes a lower part 52 and an upper part 54. The upper part 54 is designed so that it can be folded back against the lower part 52 when the high top is not being used. Hook-and-loop type fasteners 56 and 58 are used to retain the upper part 54 in a folded condition. When the high-top 80 is used, the upper part 54 can be unfolded so that it extends to the top of the high-top. When the tongue 50 is unfolded, fasteners 56 mate with corresponding fasteners (not shown) on the inside of the shoe upper 20. In a similar fashion, the fasteners 58 mate with corresponding fasteners (not shown) on the inside of the detachable high-top 80. Thus, the fasteners 56 and 58 hold the tongue 50 in place and prevent it from shifting during athletic activity.

Referring now to FIG. 3, the construction of the shoe upper is shown in more detail. The upper 20 includes an outer layer 40 which is made of leather, vinyl, nylon mesh, or canvas, or a combination of these materials. The outer layer 40 may comprise one or more overlapping pieces which are bonded and/or stitched together. The individual pieces of the outer layer 40 may be of different colors and include a variety of intricate shapes or cut-outs to make a pleasing aesthetic design.

The upper 20 also includes an inner lining 42. The inner lining 42 preferably extends around at least the heel portion 22 of the shoe and the underside of the tongue 50. If desired, the lining 42 may cover the entire inner surface of the upper. A padding material may also be interposed between the lining 42 and the outer layer 40 at predetermined locations to make the shoe fit the wearer's foot more comfortably. For example, padding may be added around the ankle opening 30 and to the tongue 50.

In a conventional shoe, the inner lining 42 would be joined at its upper end to the outer layer 40. In the present invention, a separate collar piece 44 is used. The collar piece 44 includes an upper edge and a lower edge. The upper edge of the collar piece 44 is stitched to the upper edge of the shoe lining 42. The lower edge of the collar piece 44 is attached to the inner surface of the outer layer 40 at some distance below the upper margin of the ankle opening 30. Consequently, a pocket 46 is formed between the outer layer 40 and the collar piece 44 that extends around the ankle opening 30. The pocket 46 may be continuous. However, in the embodiment shown, a separate pocket 46 is formed on either side of the ankle opening 30. Each pocket extends from the front of the ankle opening 30 to the heel portion 22. An elastic connector extends around the heel portion 22 of the shoe and joins the two flaps 48 together. As will be hereinafter described, the detachable high-top 80 fits into the pocket 46 and the outer layer 40 forms a flap 48 that covers the lower edge of the detachable high-top 80. Slots 34 are formed in the flap 48 which are used to secure the high-top to the upper 20 as will be described below.

While it is preferred that the pocket 46 be formed by adding a collar piece 44 as previously described, it will be readily apparent to those skilled in the art that a pocket to receive the detachable high-top 80 can also be formed by attaching external flaps to the outer layer 40 of the shoe upper.

The shoe is formed by placing a pre-formed upper 20 and a pre-molded outsole portion 14 in an injection mold and injection molding the midsole portion 16 to bond all three components together.

The detachable high-top 80 is in the form of an open cuff that extends around the wearer's ankle. The high-top 80 includes an outer layer 82 made of leather, vinyl, nylon mesh, canvas, or a combination of these materials. The outer layer 82 may comprise one or more individual pieces which are overlapped and stitched together. The inner layer 84 is made using the same lining material which was used for the shoe upper 20. A padding material is added between the outer layer 82 and inner layer 84 to form a soft, cushioned ankle cuff.

A series of slots 86 are formed along the lower edge of the detachable high-top 80. The slots 86 preferably align with the slots 34 in the shoe upper. A securing strap 90 threads through the corresponding slots 34 and 86 in the shoe upper and the detachable high-top respectively to secure the detachable high-top 80 to the shoe upper 20. The strap 90 preferably includes plastic end pieces 92 with a lace opening 94. The lace openings 94 in the end pieces 92 preferably, but not necessarily, align with corresponding lace openings 36 in the shoe upper 20. The shoe lace 38 can be threaded through the lace openings 94 in the securing strap 90 so that when the shoe lace 38 is tightened, the securing strap 90 is placed in tension thereby providing increased support to the wearer's heel.

The high-top 80 also includes a series of lace holes 88 adjacent the front edges thereof. When the high-top 80 is attached to the shoe upper 20, the lace holes 88 in the high-top 80 form a continuation of the lace holes 36 on the shoe upper 20. The shoe lace 38 can then be laced through the lace holes 88 in the detachable high-top 80 to further secure the high-top 80.

Figure 6:
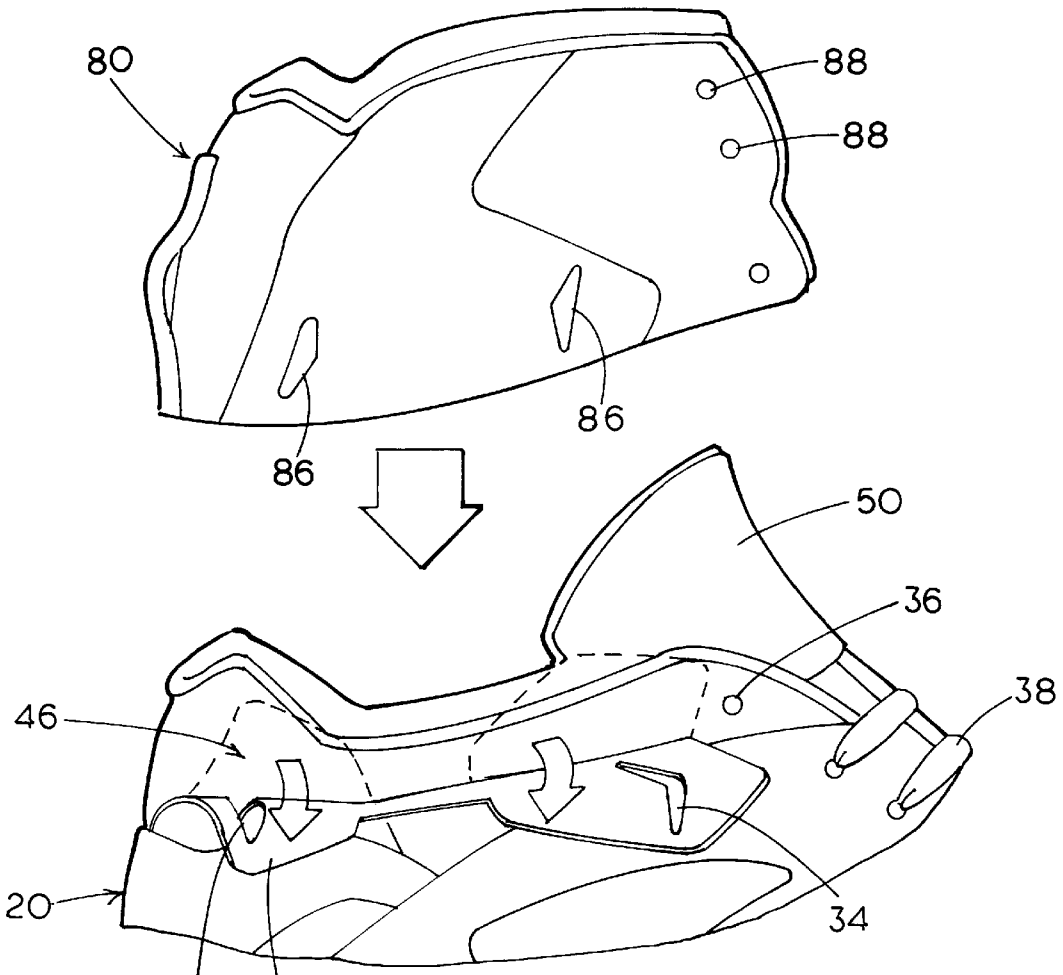
FIG. 6 is an exploded elevation view showing a portion of the shoe upper and the high-top.
Figure 7:
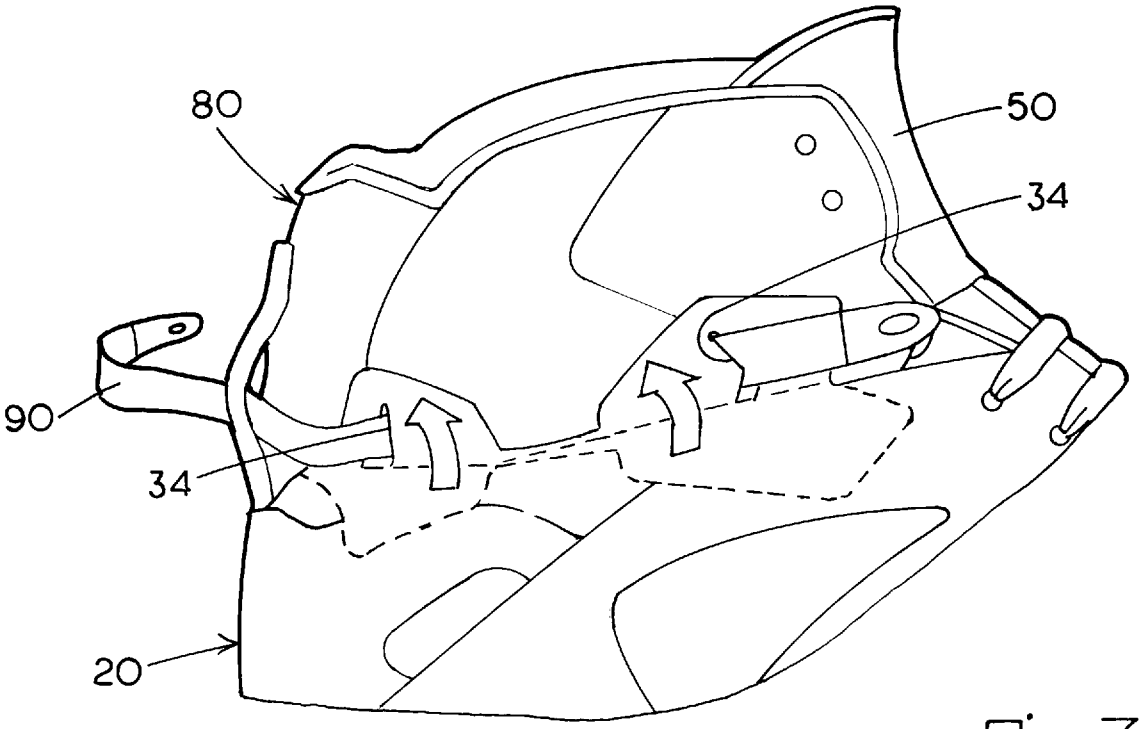
FIG. 7 is a detail showing the securing strap being fed through the slots in the upper and the high-top.
Figure 8:
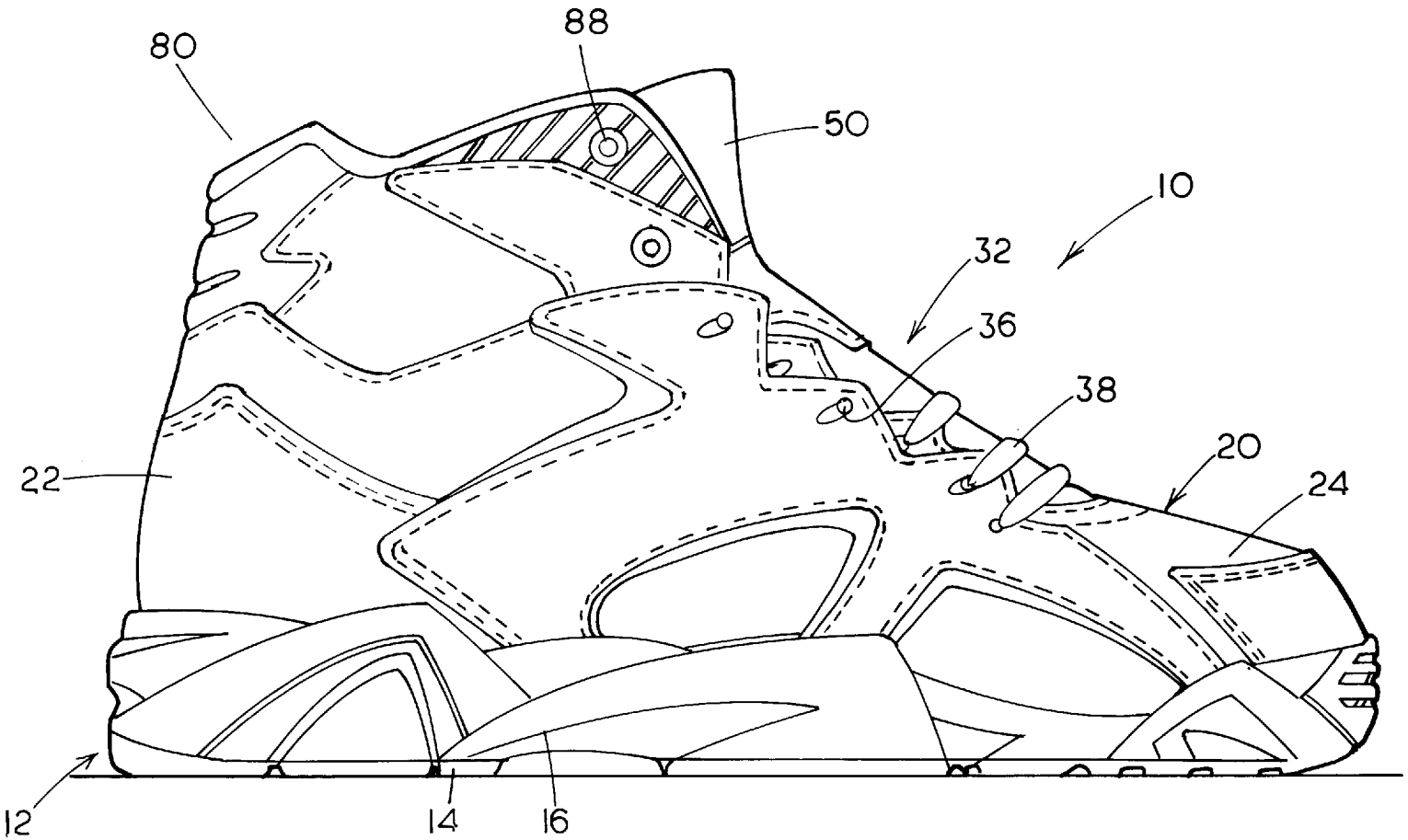
FIG. 8 is an elevation view of a second embodiment of the convertible high showing the high-top attached to the upper.
Figure 9:
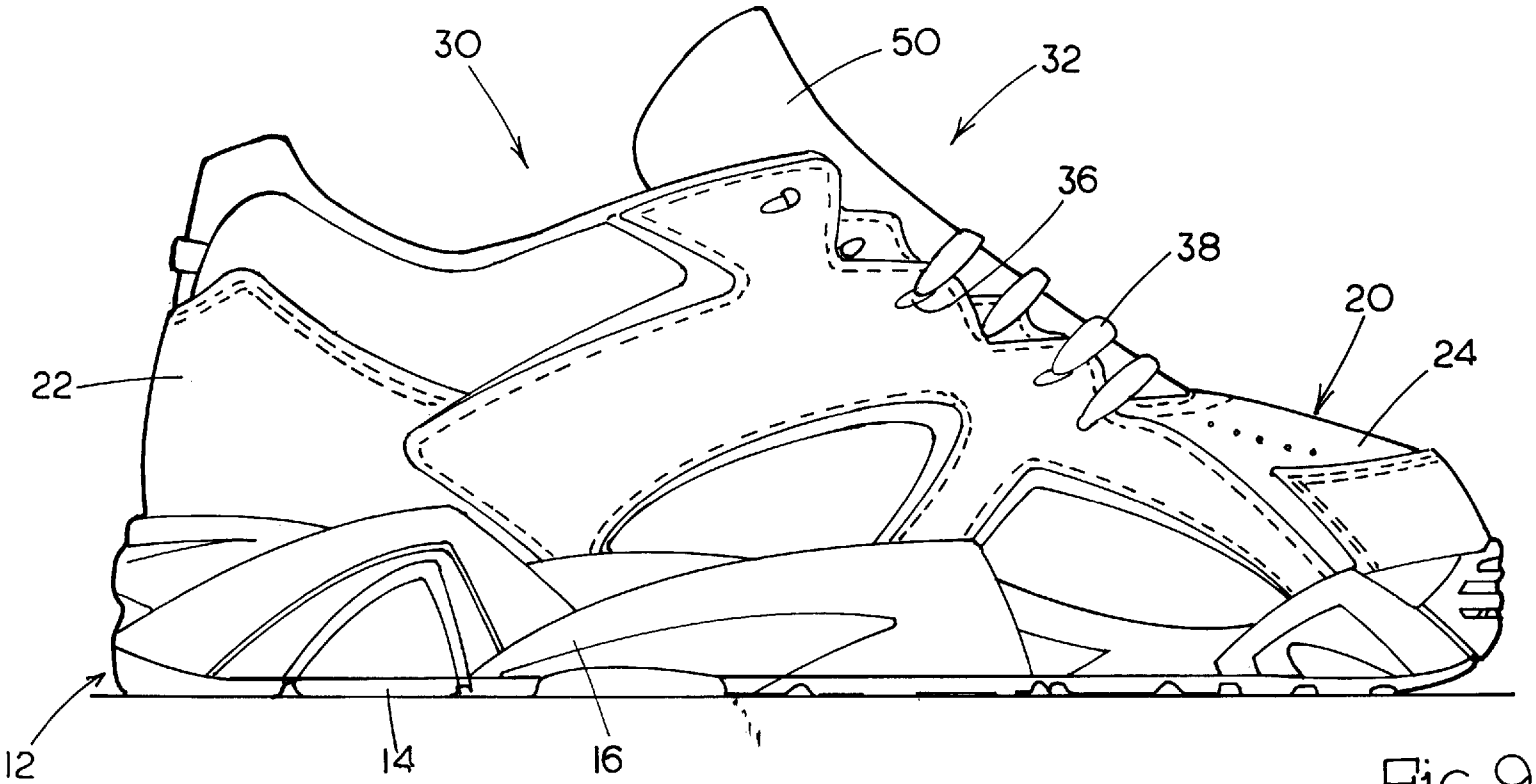
FIG. 9 is an elevation view of the second embodiment showing the high-top removed.
Figure 10:
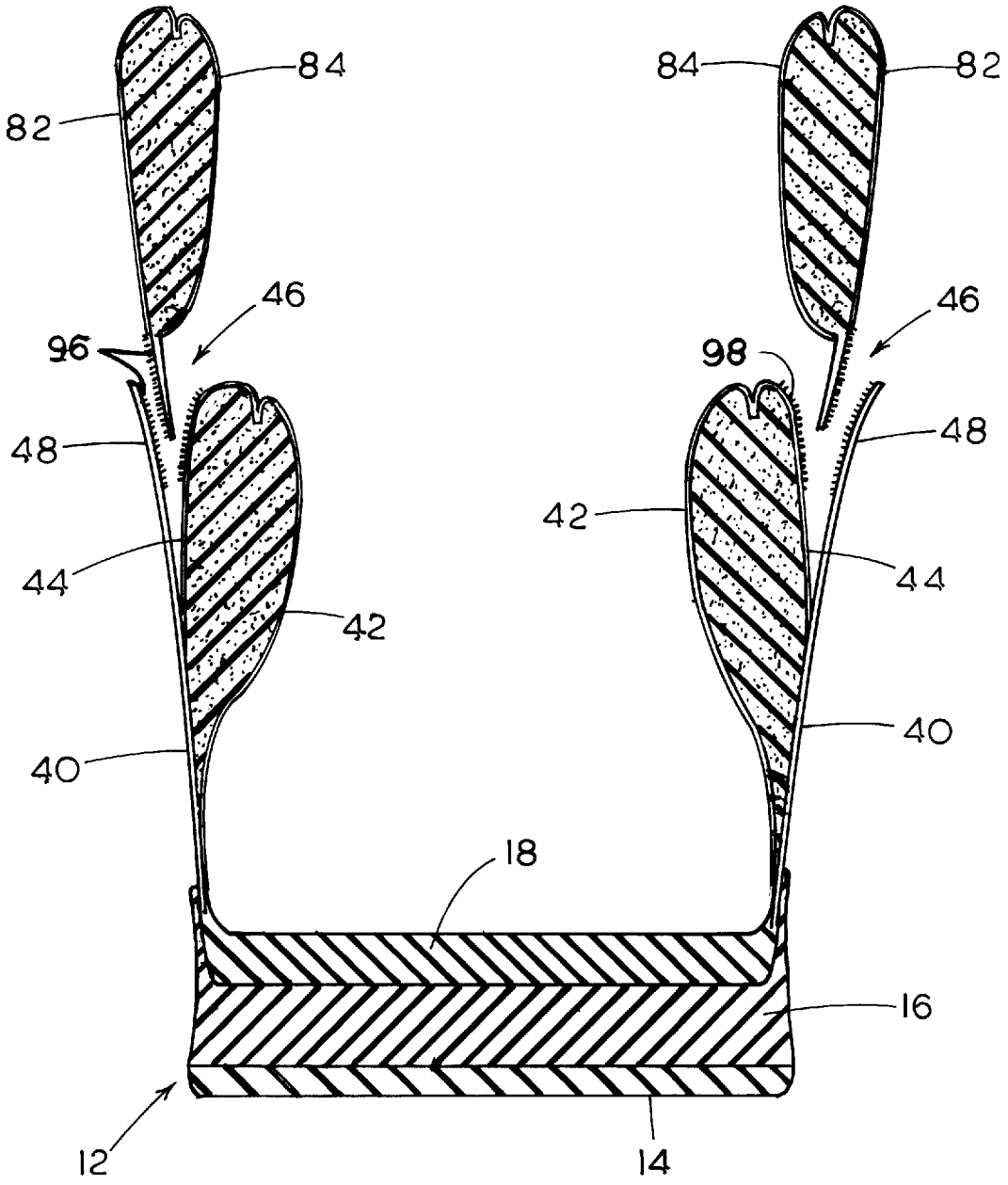
FIG. 10 is a cross-section of the shoe showing the sole assembly and the upper.
Figure 11:
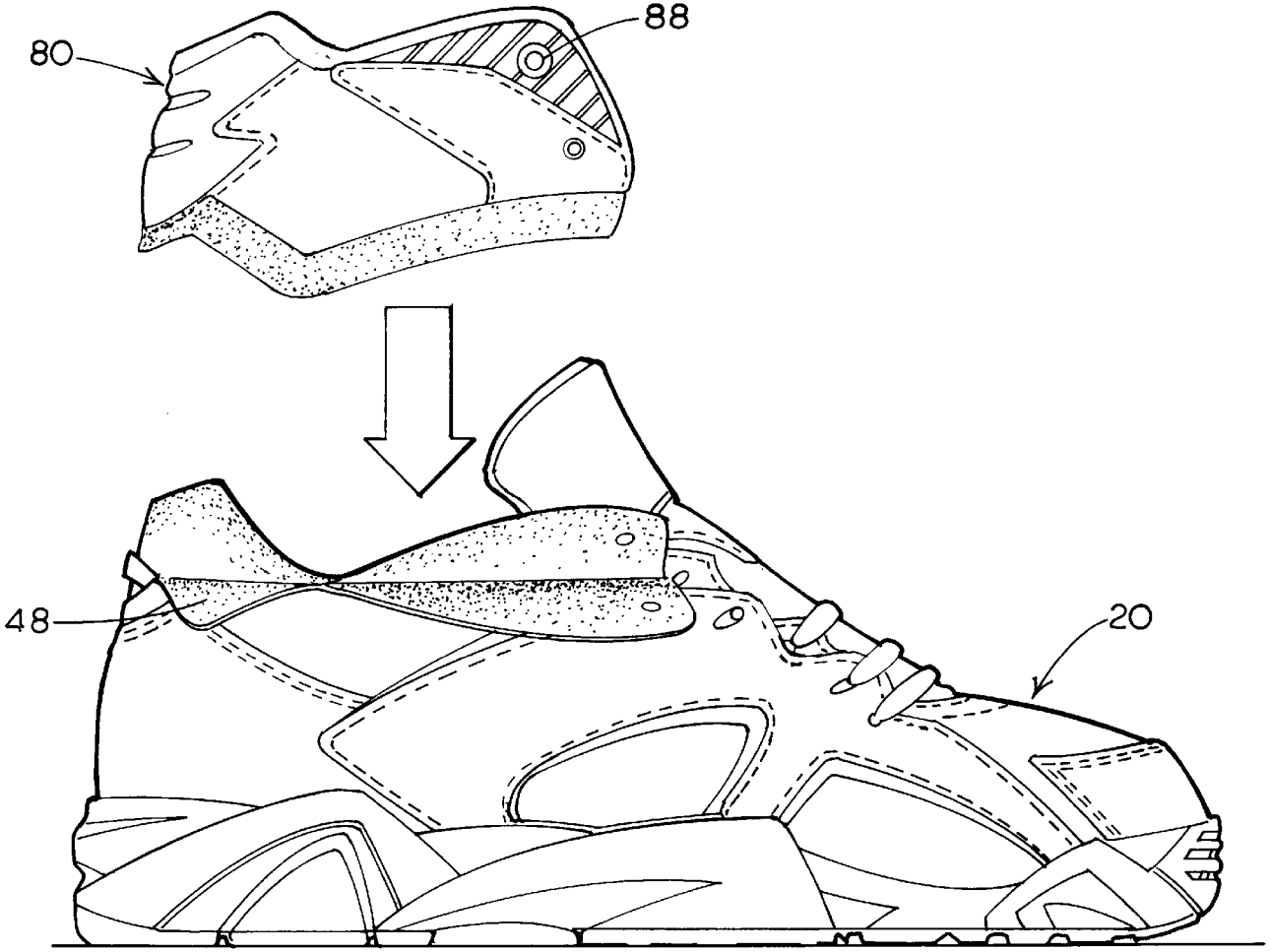
FIG. 11 is an exploded elevation view showing the upper and the high-top.

FIGS. 6 and 7 illustrate how the high-top 80 is secured to the shoe upper 20. As shown in FIG. 6, the lower edge of the high-top 80 is first inserted into the pocket 46 formed in the shoe upper 20 so that the flap 48 covers the lower edge of the high-top 80. After the high-top 80 is in place, it is secured by threading the securing strap 90 through the slots 34 in the upper and the slots 86 in the high-top 80 as shown in FIG. 7. The tongue 50 of the shoe is folded out so that it extends to the top of the detachable high-top 80. Thereafter, the shoe lace 38 is threaded through the lace openings 94 in the securing strap 90 and the lace openings 88 in the detachable high-top.

To convert the shoe back to a low-top shoe, the shoe lace is removed from the lace holes 88 in the high-top 80, the securing strap 90 is removed, and the detachable high-top 80 is lifted out of the pocket 46. If desired, the securing strap 90 may be threaded back through the slots 34 in the shoe upper 20.

Referring now to FIGS. 8 through 11, an alternate embodiment of the shoe 10 of the present invention is shown. The embodiment shown in FIGS. 8–11 is similar in most respects to the embodiment previously described. Similar reference numbers to those used in FIGS. 1–7 are therefore used in FIGS. 8–11 to indicate similar parts.

The embodiment shown in FIGS. 8–11, like the previous embodiment, includes a sole assembly 12, a shoe upper 20, and a detachable high-top 80. The sole assembly 12, shoe upper 20, and detachable high-top 80 are constructed in the same manner as previously described. However, the securing means used to secure the detachable high-top 80 to the shoe upper 20 differs from the first embodiment. Where the first embodiment used a securing strap 90 which threaded through slots in the shoe upper and detachable high-top, the second embodiment uses a hook-and-loop type fastener 96, such as Velcro® fasteners, to secure the detachable high-top 80 to the upper 20. A first part of the hook-and-loop fastener 96 is attached along the lower edge of the detachable high-top 80. In the embodiment shown in the figures, the first part of the hook-and-loop fastener 96 is attached to the outer surface of the detachable high-top 80 the lower edge thereof. The second part of the hook-and-loop fastener 96 is attached to the inner surface of the flap 48. To attach the high-top 80 to the upper 20, the lower edge of the high-top 80 is inserted into the pocket 46 formed in the upper 20 and the flap 48 is pressed against the lower edge of the high-top 80. When the flap 48 is pressed against the high-top 80, the hooks on one part of the fastener 96 entangle with the loops on the other part of the fastener 96 to releasably secure the high-top 80 to the upper 20. The high-top 80 can be removed by simply pulling the flap 48 away from the high-top 80 and lifting the high-top 80 out of the pocket 46. If desired, a hook-and-loop fastener 98 can also be attached to the collar piece 44 so that the flap 48 can be secured against the collar piece 44 when the high-top 80 is removed.

Although hook-and-loop fasteners are used preferably in the second embodiment, other types of cooperative fasteners may be substituted for the hook-and-loop fasteners. Other cooperative fasteners which might be used include snaps, buttons and zippers. This list is not exhaustive.

The present invention provides an improved convertible athletic shoe. The high-top can be quickly and easily attached or removed as circumstances require. The high-top when used provides increased ankle and heel support. The low-top shoe allows for greater freedom of movement. Thus, a single pair of shoes constructed in accordance with the present invention can be used in a wide variety of athletic activities.

What is claimed is:

1. An athletic shoe with a detachable high-top, comprising:

(a) a sole portion;

(b) an upper fixed to the sole portion, wherein the upper defines an ankle opening through which the wearer's foot is inserted into the shoe;

(c) a flap attached to the exterior surface of said upper so as to define a pocket in said upper adjacent the ankle opening;

(d) one or more strap openings formed in said flap;

(e) a detachable high-top releasably secured to the upper for converting the shoe from a low top shoe to a high-top shoe, said high-top including a lower edge that is received in the pocket defined by said flap when said high top is attached to said upper so that said flap overlies the lower edge of said high top, said high top further including one or more strap openings which align with the strap openings in said flap when the high-top is attached to the upper;

(f) a securing strap adapted to pass through the aligned strap openings in said flap and said high-top respectively for securing the detachable high-top to the upper.

2. The athletic shoe of claim 1 wherein said upper includes a tongue opening and a plurality of lace holes formed thereon on either side of the tongue opening to receive a shoe lace.

3. The athletic shoe of claim 2 wherein the securing strap includes two free-ends and a lace hole in each of the free ends that align with a corresponding lace hole on the upper, wherein the shoe lace can be threaded through the lace holes in the securing strap to aid in securing the high-top to the upper.

4. The athletic shoe of claim 1 further including a tongue having first and second parts, wherein said second part can be folded against said first part when the detachable high-top is removed and unfolded when the high-top is attached.

5. An athletic shoe with a detachable high-top, comprising:

(a) a sole portion;

(b) an upper fixed to the sole portion, wherein the upper defines an ankle opening through which the wearer's foot is inserted into the shoe;

(c) a detachable high-top having a lower edge releasably secured to the upper for converting the shoe from a low top shoe to a high-top shoe;

(d) a first cooperative fastener attached to the upper;

(e) a second cooperative fastener attached to said high-top which mates with the first cooperative fastener on the upper to secure the high-top to the upper; and (f) a flap attached to the upper adapted to cover the lower edge of the high-top as viewed from the outside of the shoe when the high-top is attached to said upper and to cover said first cooperative fastener when the high-top is removed from the upper.

6. The athletic show of claim 5 wherein said first and second cooperative fasteners are hook and loop type fasteners.

7. The athletic shoe of claim 5 wherein said upper includes a tongue opening and a lace border adjacent said tongue opening having a plurality of lace holes formed therein to receive a shoe lace.

8. The athletic shoe of claim 7 wherein the high-top includes a pair of lace holes that align with a corresponding lace holes on the upper, wherein the shoe lace can be threaded through the lace holes in the high-top to secure the high-top to the upper.

9. The athletic shoe of claim 5 having at least two flaps disposed on opposing sides of the ankle opening, and further including an elastic connector extending around the heel portion of the shoe joining the two flaps to one another.

10. An athletic shoe with a detachable high-top, comprising:

(a) a sole portion;

(b) an upper fixed to the sole portion, wherein the upper defines an ankle opening through which the wearer's foot is inserted into the shoe;

(c) a detachable high-top having a lower edge releasably secured to the upper for converting the shoe from a low top shoe to a high-top shoe;

(d) at least one flap attached to the upper adjacent to the ankle opening, said flap defining a pocket between the flap and the upper to receive the lower edge of the high-top when the high-top is attached to the upper.

11. The athletic shoe of claim 10 wherein said upper includes a tongue opening and a lace border adjacent said tongue opening having a plurality of lace holes formed therein to receive a shoe lace.

12. The athletic shoe of claim 11 wherein the high-top includes a pair of lace holes that align with a corresponding lace holes on the upper, wherein the shoe lace can be threaded through the lace holes in the high-top to secure the high-top to the upper.

13. The athletic shoe of claim 10 having at least two flaps disposed on opposing sides of the ankle opening, and further including an elastic connector extending around the heel portion of the shoe joining the two flaps to one another.

14. The athletic shoe of claim 5 including securing means for securing the high top to said upper.

15. The athletic shoe according to claim 10 further including a cooperative fastener having first and second mating parts secure said detachable high-top to said upper.

16. The athletic shoe according to claim 15 wherein said cooperative fastener is a hook and loop type fastener.

17. The athletic shoe according to claim 16 wherein the first part of said cooperative fastener is disposed in said pocket on said upper and is concealed by said flap when said high-top is detached.

* * * * *